US006039561A

United States Patent [19]

Lei

[11] Patent Number: 6,039,561

[45] Date of Patent: Mar. 21, 2000

[54] SAFETY PIEZO-ELECTRIC LIGHTER

[76] Inventor: Hou Chong Lei, Covina, Calif.

[21] Appl. No.: 09/028,107

[22] Filed: Feb. 23, 1998

[51] Int. Cl.[7] ..... F23D 11/36

[52] U.S. Cl. ..... 431/153; 431/255

[58] Field of Search ..... 431/153, 277, 431/255, 253

[56] References Cited

U.S. PATENT DOCUMENTS 4,830,603 5/1989 Cirami ..... 431/277
5,145,358 9/1992 Shike et al. ..... 431/153
5,350,294 9/1994 Iwahori ..... 431/153
5,462,432 10/1995 Kim ..... 431/153
5,662,466 9/1997 Cheng ..... 431/153

*Primary Examiner*—Carl D. Price

[57] ABSTRACT

A safety piezo-electric lighter having a one-piece safety device that is on the thumb-piece which will prevent accidental ignition and will also prevent ignition by children. The safety device on the thumb-piece does not interfere with the conventional operation of the lighter and does not require the user to manipulate a switch with a separate finger than the one used to press the thumb-piece. The one-piece safety device is very easy and inexpensive to manufacture and assemble.

1 Claim, 4 Drawing Sheets

SAFETY PIEZO-ELECTRIC LIGHTER

BACKGROUND—FIELD OF INVENTION

This invention relates to a lighter having a safety device consisting of a locking mechanism for the thumb-piece of a cigarette lighter, the igniting of which either accidentally or by children is rendered virtually impossible.

BACKGROUND—DESCRIPTION OF PRIOR ART

Cigarette lighters, particularly of the disposable type, are known to comprise, within a hollow body, a reservoir of combustible liquefied gas, a pressure reducer mounted on an outlet of the reservoir and a burner with a valve on top of the pressure reducer, and means for igniting the gas escaping from the burner after the valve is opened. This igniting means most often consists of a wheel bearing against a flint, rotation of the wheel producing sparks which are projected over the burner.

Another solution which is becoming more widespread consists in substituting a piezo-electric igniter for the flint-wheel assembly. In both cases, the gas of the cigarette lighter is ignited by pressing on a thumb-piece which is either pivoted on the body of the cigarette lighter or which slides within the body. In addition to creating one or more sparks, the thumb-piece lifts the burner as it moves, which releases the gas which is to be ignited.

The thumb-piece is pressed by the user of the cigarette lighter. However, such depression may occur accidentally, for example, in a pocket, or by an unauthorized "user", such as a child, who might misuse the cigarette lighter.

In order to overcome this drawback, the provision of locking means for the thumb-piece has been proposed. When the thumb-piece is locked, the gas cannot escape from the reservoir and no spark can be generated. This is the locked position.

However, in order to use the cigarette lighter, the thumb-piece has to be unlocked without requiring any special skill. To this end, a "before igniting" position must exist in which the cigarette lighter is ready to operate simply by pressing on the thumb-piece as in the usual operation.

OBJECTS AND ADVANTAGES

My safety piezo-electric lighter is designed to be easily operable with the conventional method of using the lighter. However, the safety device on the thumb-piece will prevent accidental ignition and will also prevent ignition by children. The safety device on the thumb-piece does not interfere with the conventional operation of the lighter and does not require the user to manipulate a switch with a separate finger than the one used to press the thumb-piece. The one-piece safety device is very easy and inexpensive to manufacture and assemble.

DRAWING FIGURE

REFERENCE NUMERALS IN DRAWINGS

Figure 1:
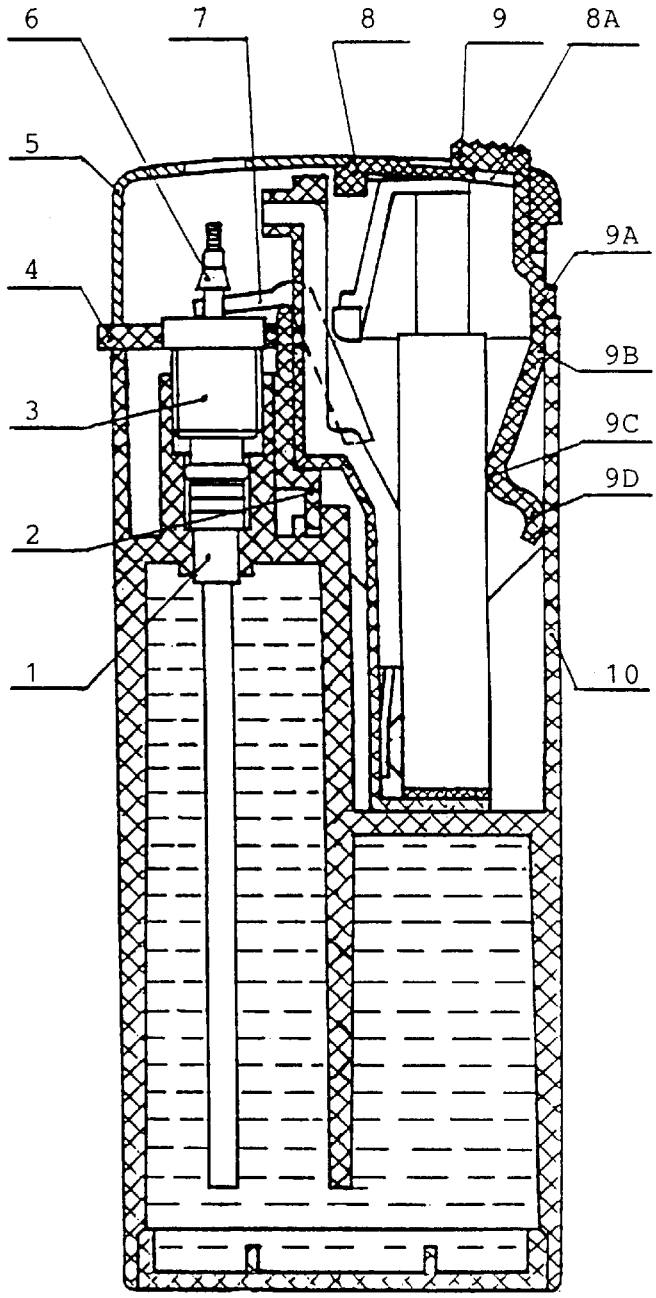
FIG. 1 shows the preferred embodiment of the safety piezo-electric lighter.

Description—FIG. 1

A preferred embodiment of the safety piezo-electric lighter of the present invention is illustrated in FIG. 1. The safety piezo-electric lighter has a body 10 which contains the combustible liquid gas. A fluid connection 1 is made between the valve assembly 3 and the combustible liquid gas. The vale assembly 3 is set in a support 2. A pressure reducer 4 is rigidly connected at the end of the valve assembly 3. A burner 6 is rigidly connected to the other end of the pressure reducer 4. A wind shield 5 is rigidly connected to the end of the body 10 with the burner 6. A thumb-piece 8 is slidably connected to the end of the body 10 next to the wind shield 5. An one-piece safety device 9 is slidably installed in a slit 9E in the thumb-piece 8.

Figure 2:
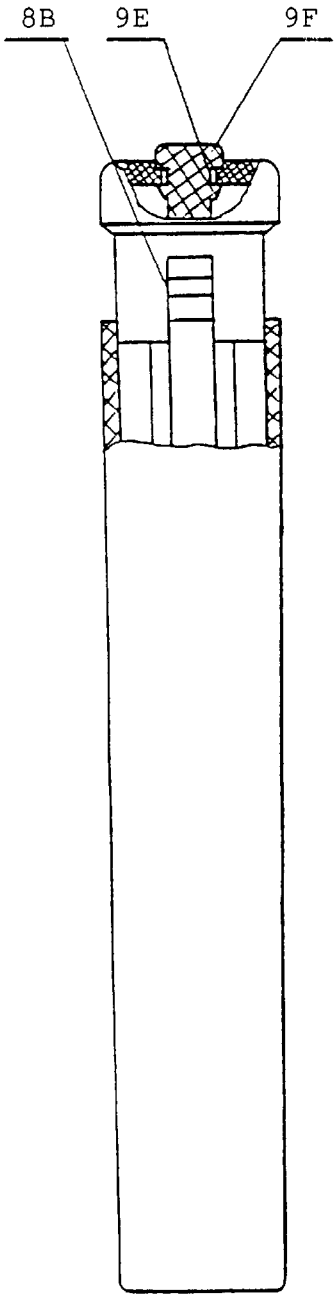
FIG. 2 shows a side view of the preferred embodiment of the safety piezo-electric lighter.

Description—FIG. 2

FIG. 2 shows a side view of the preferred embodiment of the safety piezo-electric lighter shown in FIG. 1. The thumb-piece 8 has a longitudinal slit 8B on its vertical face. The top of the one-piece safety device 9E is slightly wider than the body of the one-piece safety device 9F.

Figure 3:
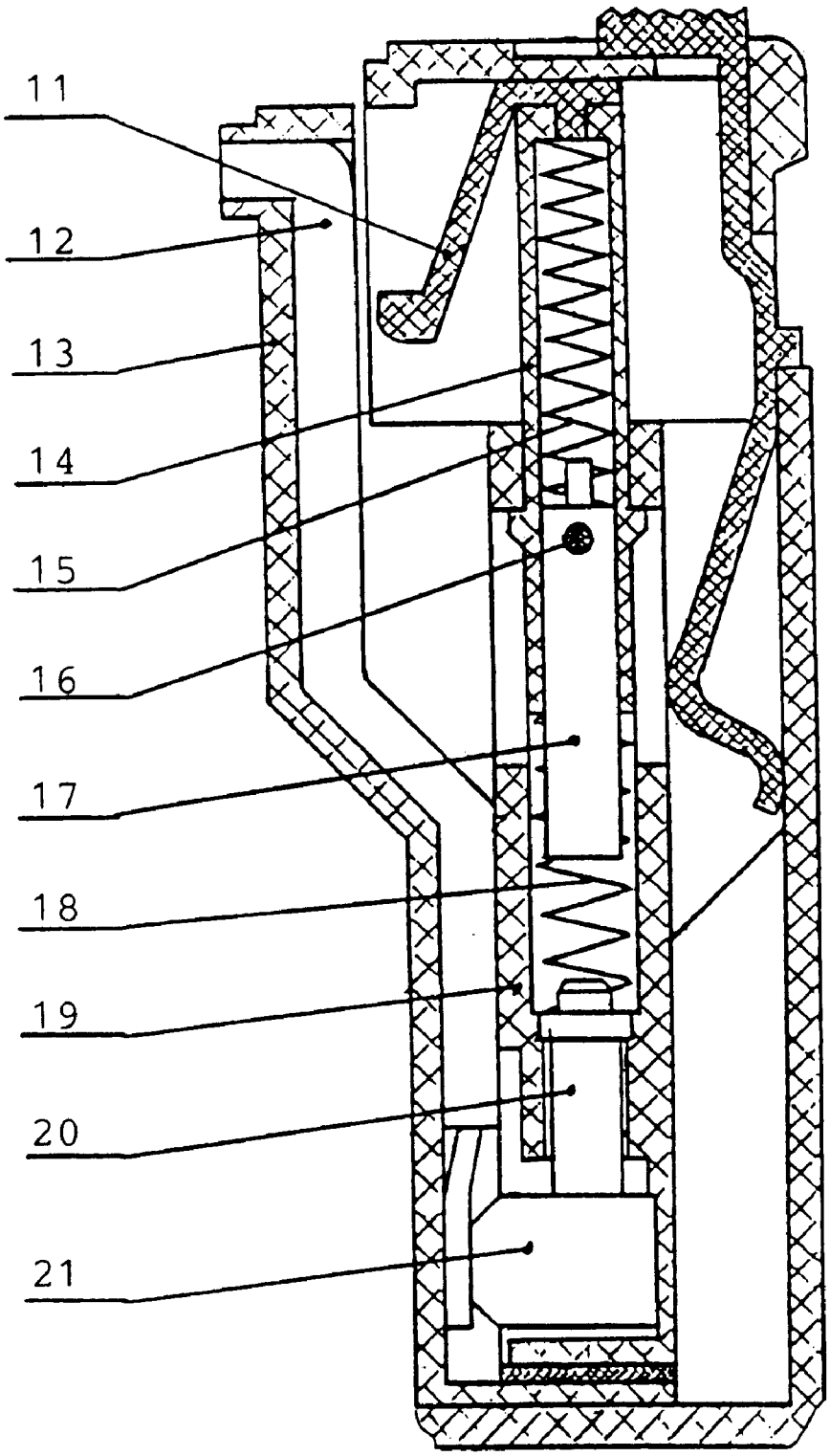
FIG. 3 shows a detailed view of the safety ignition assembly.

Description—FIG. 3

FIG. 3 shows a detailed view of the safety ignition assembly. The safety ignition assembly comprises the base 21 with an igniter 20 rigidly attached on top of it and a conductor 12 rigidly attached to the side of the base 21. Rigidly attached to said conductor is a flame shield 13. An outside cover 19 surrounds the igniter 20 and extends upward. Within said outside cover 19 and on top of the igniter 20 is a bottom spring 18 which supports a piston 17. Near the top end of the piston 17 is a locking pin 16 rigidly attached to the piston 17. On top of the piston 17 is a top spring 15 which is surrounded by an inside cover 14. On top of said inside cover 14 is a rigidly attached pressing lever 11.

Figure 4:
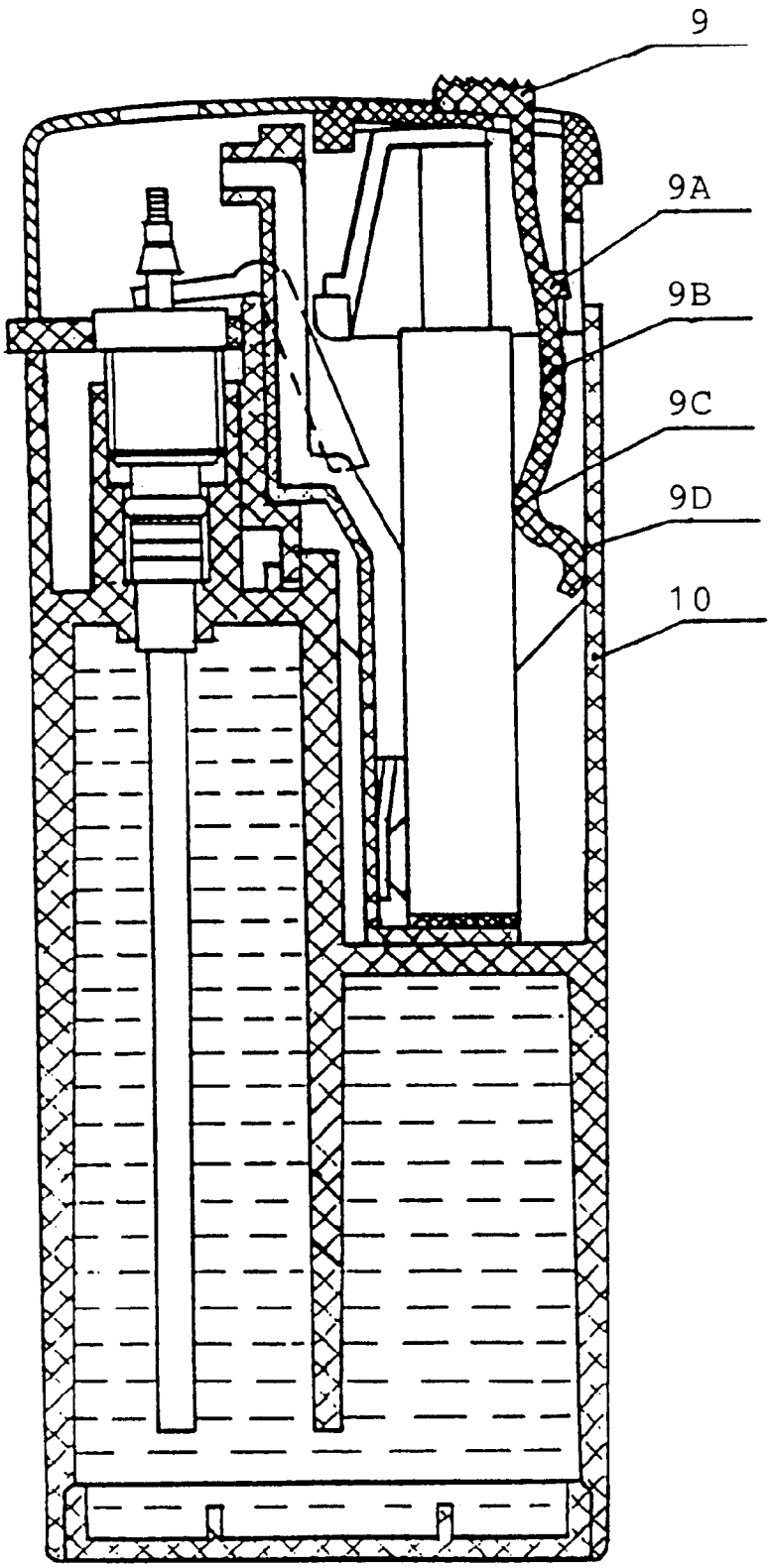
FIG. 4 shows the position of the safety device in the unlocked, before ignition position.

Description—FIG. 4

FIG. 4 shows the position of the one-piece safety device 9 in the unlocked, before ignition position. In the unlocked position, the one-piece safety device 9 is slid toward the wind shield 5. In said position, a protrusion 9A is disengaged from the longitudinal slit 8B on the vertical face of the thumb-piece 8 and the end of the body 10. The bottom portion of the one-piece safety device 9 is curved in an S-shape with opposing curvatures at 9B, 9C, and 9D. Curve surface 9B is urged away from the surface of the body 10. Curve surfaces 9C and 9D engage the outside cover 19 and the body 10 respectively to form a one-piece springing member.

Figure 5:
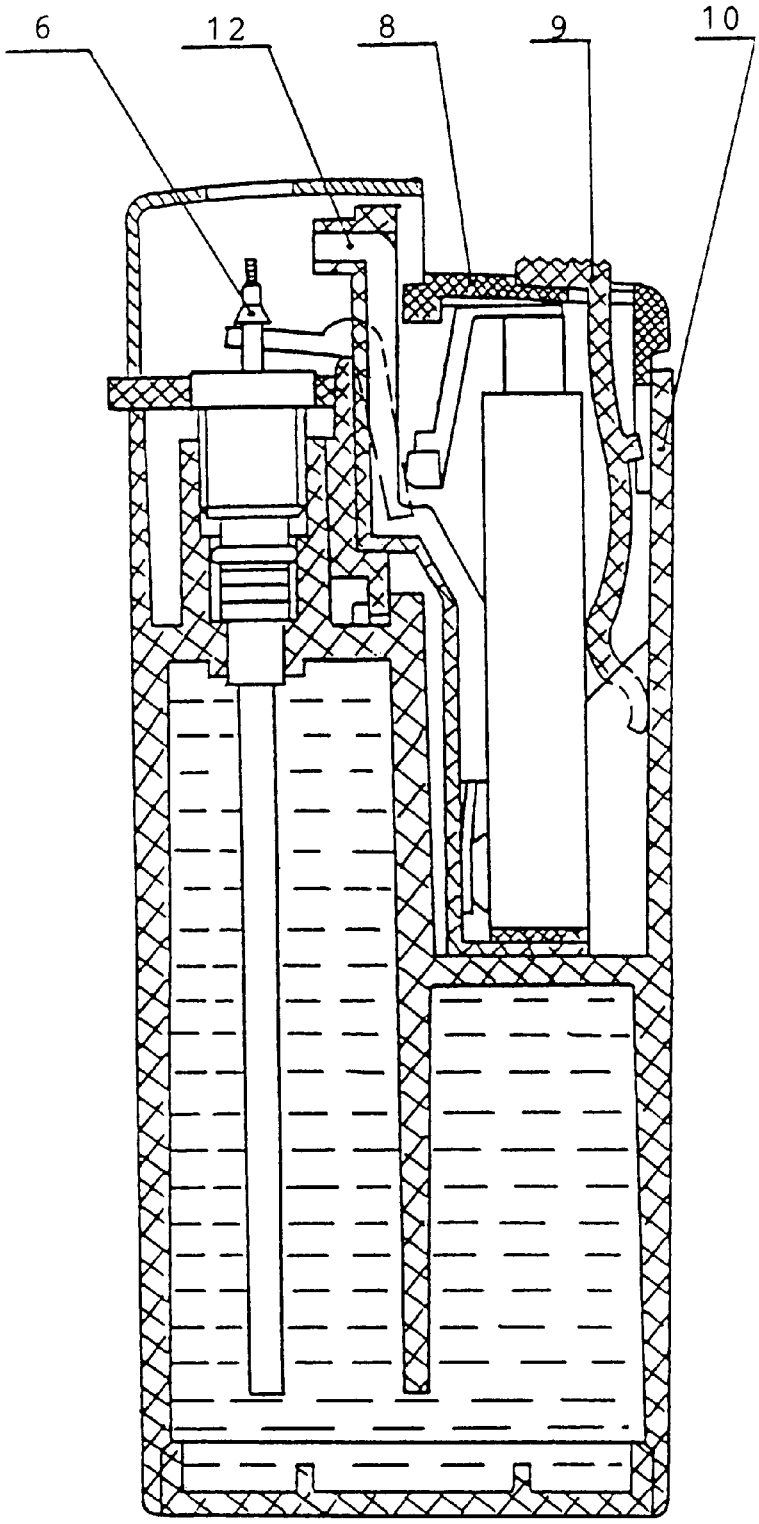
FIG. 5 shows the position of the safety device and the thumb-piece in the ignition position.

Description—FIG. 5

FIG. 5 shows the position of the one-piece safety device 9 and the thumb-piece 8 in the ignition position. In this position, the thumb-piece 8 is pressed down toward the other end of the body 10. The one-piece safety device 9 is in the unlocked position as in FIG. 4.

Operation

The manner of using the safety piezo-electric lighter is by simple sliding the one-piece safety device 9 towards the wind shield 5 thereby disengaging the protrusion 9A from the longitudinal slit 8B on the vertical face of the thumb-piece 8 and the end of the body 10 thereby allowing the thumb-piece 8 to travel toward the other end of the body 10 and start the ignition process.

Summary, Ramifications, and Scope

Accordingly, it is clear that the safety piezo-electric lighter of this invention with the one-piece safety device on the thumb-piece will prevent accidental ignition and will also prevent ignition by children. The safety device on the thumb-piece does not interfere with the conventional operation of the lighter and does not require the user to manipulate a switch with a separate finger than the one used to press the thumb-piece. The one-piece safety device is very easy and inexpensive to manufacture and assemble.

Although the descriptions above contains many specifications, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A safety piezo-electric lighter of the type comprising:

a. a hollow body including a reservoir for gas fuel;

b. ignition means provided at one end of the body, the ignition means including:

A. a valve mechanism in fluid connection with the reservoir and operable for selectively discharging gas fuel stored in the reservoir through the valve mechanism;

B. gas-release means connected to the valve mechanism and supported by means on the housing to be movable relative to the housing between a first position where gas is not discharged through the valve mechanism and a second position where gas is discharged through the valve mechanism; and C. a safety ignition mechanism connected to the gas-release means for igniting the gas fuel discharged through the valve mechanism, wherein the safety ignition mechanism comprises of i. a thumb-piece connected to the gas release means and slidably supported to move relative to said body and attached to the safety mechanism, said thumb-piece having a horizontal upper surface and a vertical surface, a horizontal slit through the thumb-piece horizontal surface and a longitudinal slit formed through the thumb-piece vertical surface;

ii. a one-piece safety device of flexible material attached to the thumb-piece, an upper protrusion of the one-piece safety device is connected to an underside surface of the thumb piece and is slidably supported along said horizontal slit and includes an operating surface which is exposed on the horizontal upper surface so as to be engaged by a user's thumb during operation of the safety ignition mechanism, said one-piece flexible safety device includes a lower portion positioned in a space defined between the body and the underside of the thumb-piece, a second protrusion formed on a middle portion of said one-piece safety device, said second protrusion arranged to slidably engage the longitudinal slit on the vertical surface of the thumb-piece such that when the safety device is in a locked position, located in the vertical longitudinal slit and positioned between a lower portion of the thumb-piece and an upper portion of the body, so as to block movement of the thumb-piece relative to the body and therefore prevent operation of the gas release means, and the lower portion of the one-piece safety device is formed in an S-shape that is secured in the body to cause a force on the middle portion and the upper portion of the one-piece safety device for biasing the middle portion to the locked position.

* * * * *